US008307612B1

(12) United States Patent
Sikorcin

(10) Patent No.: US 8,307,612 B1
(45) Date of Patent: Nov. 13, 2012

(54) BALLOON FILLING AND TYING DEVICE

(76) Inventor: Wayne Sikorcin, Lisle, IL (US)

( * ) Notice: Subject to any disclaimer, the term of this patent is extended or adjusted under 35 U.S.C. 154(b) by 0 days.

(21) Appl. No.: 13/092,325

(22) Filed: Apr. 22, 2011

(51) Int. Cl.
*B65B 7/02* (2006.01)
*A63H 27/10* (2006.01)
*D03J 3/00* (2006.01)

(52) U.S. Cl. ..... 53/284.7; 141/313; 141/317; 141/98; 141/114; 289/17

(58) Field of Classification Search ..... 141/313, 141/314, 317, 98, 114; 289/17, 18.1; 53/284.7, 53/79
See application file for complete search history.

(56) References Cited

U.S. PATENT DOCUMENTS 3,692,071 A * 9/1972 Begleiter ..... 141/313
4,989,906 A 2/1991 Peverley
5,016,428 A 5/1991 Helling
5,439,199 A * 8/1995 Briggs et al. ..... 251/320
5,611,578 A * 3/1997 Angelico et al. ..... 289/17
8,141,326 B2 * 3/2012 Wang ..... 53/284.7
2002/0088894 A1 7/2002 Garza
2011/0253255 A1 * 10/2011 Dellaquila ..... 141/98
2011/0253256 A1 * 10/2011 Finley ..... 141/98
2012/0085430 A1 * 4/2012 Johansson et al. ..... 137/231
2012/0097293 A1 * 4/2012 Dancescu et al. ..... 141/317
2012/0144776 A1 * 6/2012 Sikorcin ..... 53/268

* cited by examiner

*Primary Examiner* — Timothy L Maust
*Assistant Examiner* — Timothy Kelly
(74) *Attorney, Agent, or Firm* — Howard B. Rockman

(57) ABSTRACT

An apparatus for filling a balloon with a fluid and tying a knot in the neck of the balloon, having a filling device body engaging a source of fluid under pressure. A balloon barb extends outwards from the body, and a fluid passageway in the body communicates with a control to allow the passage of fluid from the source to the balloon barb. A tying device extends from the body substantially parallel to the balloon barb, the tying device being detachable from and reattachable to a receptacle in the body of the filling device. A keyway is located either the tying device or an inner surface of the receptacle, and a key is located in the other of the tying device or the receptacle. The key corresponds in dimensions to fit in the keyway, where the key removably fits into the keyway when the tying device is inserted in the receptacle of the body of the filling device. A snap fit removably holds the tying device in the receptacle, and an elongated nozzle flange on the balloon barb prevents leakage of fluid when the balloon is being filled.

13 Claims, 6 Drawing Sheets

1A
1B
10
12
14
16
18
20
22
24
26
30
31
32
33
34
36
38
44
46
50
52
60
63
64
65
65a
66
67
68
68B
69
71
72
76

BALLOON FILLING AND TYING DEVICE

FIELD OF THE INVENTION

The present invention relates to devices for filling and tying balloons, and more particularly, to an apparatus for filling balloons with a fluid such as air or water, and readily tying a knot in the neck of the balloon using a tying device removably attached to a filling device.

BACKGROUND OF THE INVENTION

The use of balloons for child's play and at weddings and parties is well known. In such cases, balloons are often used as decorations or centerpieces. Sometimes, balloons may be used to line windows or the walls of homes or reception halls. Usually the balloons are brightly colored to add a sense of festival to the occasion.

Balloons can also be used for advertising. In this case, messages, trademarks or logos may be imprinted on an outer surface of the balloon to promote a product or simply enhance brand awareness. When used for advertising, the balloons may be given away at festivals or fairs or other events.

Balloons may be provided in any of a number of sizes. Relatively small balloons may be provided for use as decoration. Larger balloons may be used for advertising. In some cases, balloons of several feet in diameter may be imprinted with a message and filled with helium so that they float. Such balloons may be tethered to the ground over businesses to attract attention to special events.

In the case of children, balloons may be provided as a source of amusement. For younger children, balloons may be used to play games (e.g., a form of volleyball where the slow movement of the balloon is more adapted to the dexterity of the small child.) Alternatively, a balloon may be filled with water for use with larger children and adults. When filled with water, such balloons may be used for water-fights on hot days, and for other games of interest to children.

While balloons have an almost infinite utility to both inform and amuse, they are labor intensive to use. When used, a balloon must be inflated by a person pressing his/her lips to the balloon and blowing air into the balloon. Where the balloon is to be filled with helium or water, the balloon may be attached to a pressured source of helium or water. Once filled, the entrance to the balloon must be closed to prevent the fluid from escaping. In many cases, the neck of the balloon is tied in a knot. However, the step of tying the neck of a balloon into a knot is especially laborious and difficult for a young child or even for an adult. Because of the importance of balloons, better methods are needed for filling and then tying knots in the necks of balloons.

The present invention is described in the context of filling a balloon with water, and then knotting the neck of the balloon. However, the same description would also be applicable were the balloons to be filled with another fluid, such as air or helium, or the like.

The present disclosure relates to a balloon filling and tying device. In particular, the filling device is improved with an elongated nozzle flange structure on the marginal end of the balloon barb to prevent water dripping when a water balloon is filled. When the user ties the neck of a balloon, they may find that they inserted the tying device into the receptacle the wrong way. To eliminate this problem, this invention uses a key and corresponding keyway structure located on the tying device and in the filling device receptacle, respectively. This structure prevents the user from inserting the tying device into the receptacle incorrectly, and also prevents the tying device from rotating during the course of tying a knot in the neck of a balloon. The inner diameter of the back end of the receptacle is also slightly smaller than the outer diameter of the proximal end of the tying device. This feature also helps the user to insert the tying device into the receptacle from the front side and stops the user from improperly inserting the tying device into the receptacle of the filling device from the rear. A snap fit feature is also used to better engage the tying device and the filling device.

The tying device has a curved and larger bevel than the bevel illustrated in the prior art and in previous balloon tying devices. This improvement is provided to allow the bevel to better receive the rolled mouth of the water balloon. In order to help the user better insert the neck of the balloon into the slot on the tying device, a pair of leading tapered surfaces are provided on the marginal end of the tying device.

The present tying device invention is an improvement over the tying device disclosed in my U.S. Pat. No. 7,549,683, issued Jun. 23, 2009, the contents of which are incorporated herein by reference. The present combination tying device and balloon filling invention is an improvement over the balloon tying device and filling apparatus disclosed in my co-pending patent application entitled "Balloon Filling Device," filed Dec. 10, 2010, bearing Ser. No. 12/965,036, the contents of which are incorporated herein by reference.

SUMMARY OF THE INVENTION

A combined balloon filling and tying device is provided for filling the balloons with a fluid such as water, and readily tying knots in the neck of the balloons. The filling device includes a body adapted to engage a source of fluid under pressure, a balloon barb extending outwards from the body along a predominant axis, the balloon barb extending from the body.

On the marginal end of the balloon barb, an elongated bottom nozzle flange structure on one side of the balloon barb prevents the water or other fluid from dripping from the neck of a balloon when filling the balloons. The filling device also includes a manually operated valve to open and close the internal conduit in the body and connect a pressurized source of water received through a coupler. The tying device removably extends from the body of the filling device parallel to the balloon barb, the tying device being detachable and reattachable to the body through a receptacle in the filling device.

A key and corresponding keyway structure are located, on the tying device and in the receptacle. This structure helps the user insert the tying device into the receptacle in the only correct way. The key and keyway structure also prevents the tying device from rotating during the course of tying a knot in the balloon. There is also a snap fit feature engaging the tying device to the receptacle, and the outer diameter of one end of the tying device is larger than the inner diameter of the rear end of the receptacle to prevent the tying device from being inserted into the wrong end of the receptacle.

The tying device includes a cylindrical shaft, a slot extending across a marginal end of the cylindrical shaft with a depth of the slot extending along a longitudinal axis of the shaft, and a bevel located on a first side of the cylindrical shaft on opposing sides of the slot and extending from a root of the slot towards the marginal end. The shaft has a tapered end on a side of the shaft opposite the bevel, with the taper starting adjacent the root of the slot and ending with a maximum taper on the marginal end and where the taper is divided by the slot.

The shaft has leading tapered surfaces on the side of the shaft opposite the bevel, the leading tapered surfaces starting at the marginal end of the shaft, extending on the shaft in a longitudinal direction away from the marginal end of the shaft and ending on the internal walls of the slot. The bevel curves on the shaft both longitudinally and circumferentially, and the intersection between the bevel edges and the shaft are curved lines on both sides of the slot.

The bevel is larger than the bevel structure illustrated in the prior art and is provided to better receive the rolled mouth on the distal end of the neck of a balloon. The leading tapered surfaces are provided to help the users insert the neck of the balloon into the slot of the tying device.

DETAILED DESCRIPTION OF AN ILLUSTRATED EMBODIMENT

Figures 1, 1A, 1B:
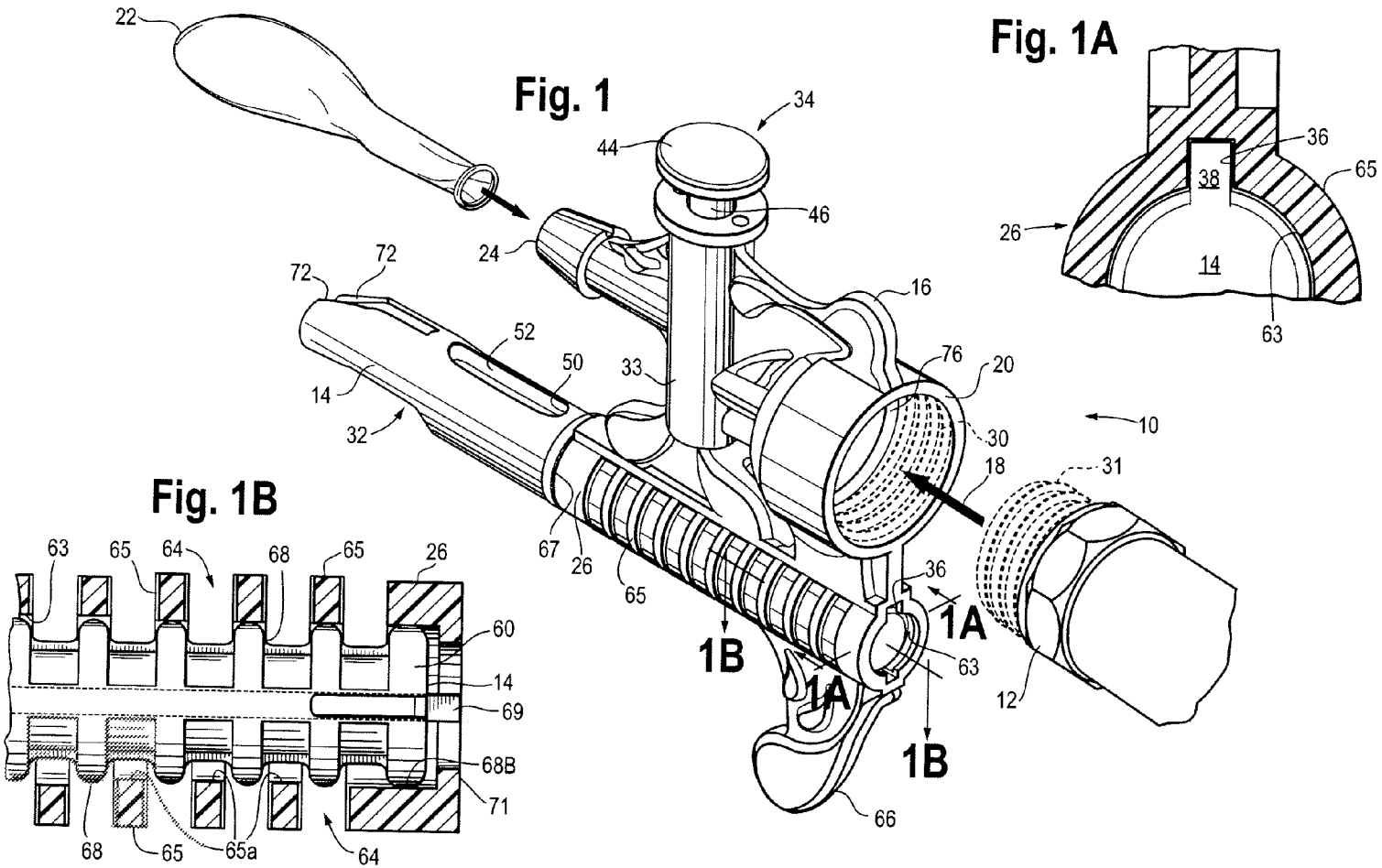
FIG. 1 is a front-side perspective view of the combined balloon filling and balloon tying devices shown generally in accordance with a first illustrated embodiment of the invention, and showing a source of fluid about to be attached to the filing device, and a balloon about to be attached to a balloon barb formed as part of the filling device.
FIG. 1A is a detail section view of the keyway located inside the receptacle of the embodiment of FIG. 1, taken along line 1A-1A in FIG. 1.
FIG. 1B is a detail section view of the snap fit feature of the balloon filing and balloon tying devices of the embodiment of FIG. 1, taken along line 1B-1B in FIG. 1.
Figure 3:
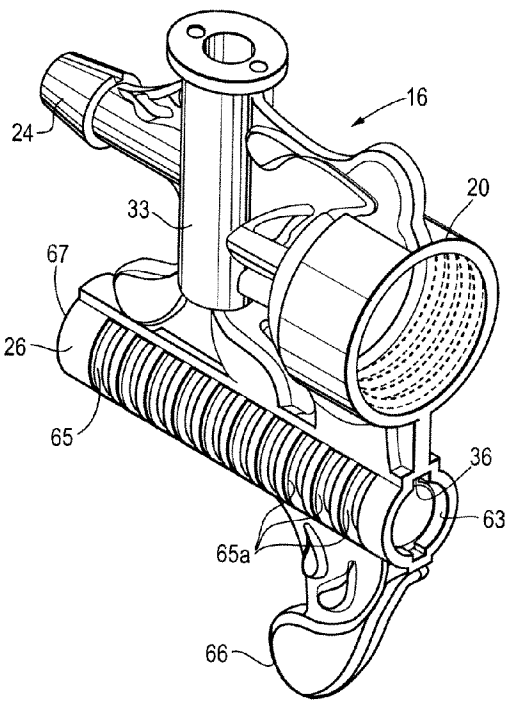
FIG. 3 is a front side perspective view of the balloon filling device of the embodiment of FIG. 1 with the balloon tying device and the actuator valve removed from the balloon filling device.

Referring to FIG. 1, a combination device 10 for filling and tying pressurized flexible containers such as balloons is shown. Device 10 is shown generally in accordance with a first illustrated embodiment of the invention. As explained further, the device 10 may be used for filling water balloons 22.

The filling and tying device 10 comprises a body or housing 16 and a detachable balloon tying device 14. The detachable balloon tying device 14 may be removed from the body 16 and used separately for tying balloons, as disclosed in my U.S. Pat. No. 7,549,683.

The device 10 may be connected 18 to a source of pressured fluid, such as a garden hose 12 providing a pressurized fluid (e.g., water), with the pressure used to fill the balloon with the fluid. An internal thread 30 of a female hose connector 20 is adapted to engage an external thread 31 on a male end of the garden house 12. A washer 76 is located inside hose connector 20.

The combined filling and tying device 10 generally includes the body or housing 16 that supports the threaded female hose connector 20, a fill nozzle or balloon barb 24, and a finger grip 66. A receptacle 26 is provided to receive and removably secure the balloon tying device 14 to the housing 16. The balloon barb 24 extends from body 16 along a predominant axis, and the tying device extends along a second axis displaced from the predominant axis. An internal channel or conduit 28 (FIG. 2) connects the fluid in the female hose connector 20 to the hollow tube formed in balloon barb 24.

Figure 2:
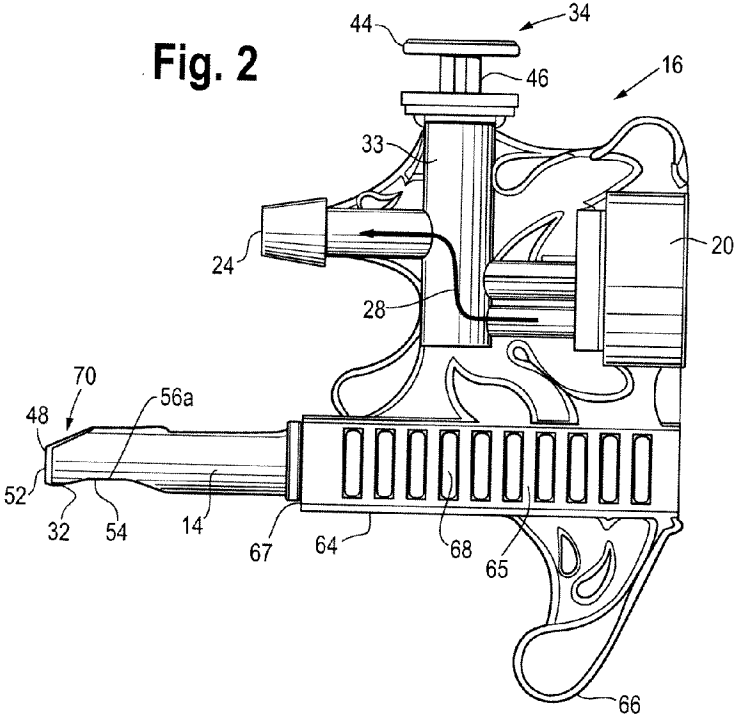
FIG. 2 is a side elevation view of the combined balloon filling and balloon tying devices of the embodiment of FIG. 1.

The detachable balloon tying device 14 is adapted to be coupled at a proximal end 60 to the housing 16 by inserting the proximal end into the receptacle 26, with an outward end 32 extending outwards alongside and substantially parallel to the balloon barb 24. The balloon barb 24 and tying device 14, therefore, extend outwards from the housing 16 in a mutually parallel arrangement. The distal or outward end 32 of the tying device 14 generally extends outwards from the housing 16 beyond the end of the balloon barb 24, as seen in FIG. 2.

The filling and tying device 10 includes a valve housing 33 and a valve 34. The valve 34 may include a water control button 44 extending from an upper surface of the housing 16, and a valve shaft 46. The shaft 46, in turn, may be provided with one or more O-rings around a periphery of a far end inside valve housing 33 that alternately block and open the conduit 28 allowing the passage of water from hose 12 to balloon barb 24. The valve 34 may be used to manually open and close the internal conduit 28 and, in turn, to connect a pressurized source of water received through the coupler 20 to a balloon through the barb 24. In the illustrated embodiment, pressing downward on water control button 44 opens conduit 28 and allows water to pass to balloon barb 24.

Figure 4:
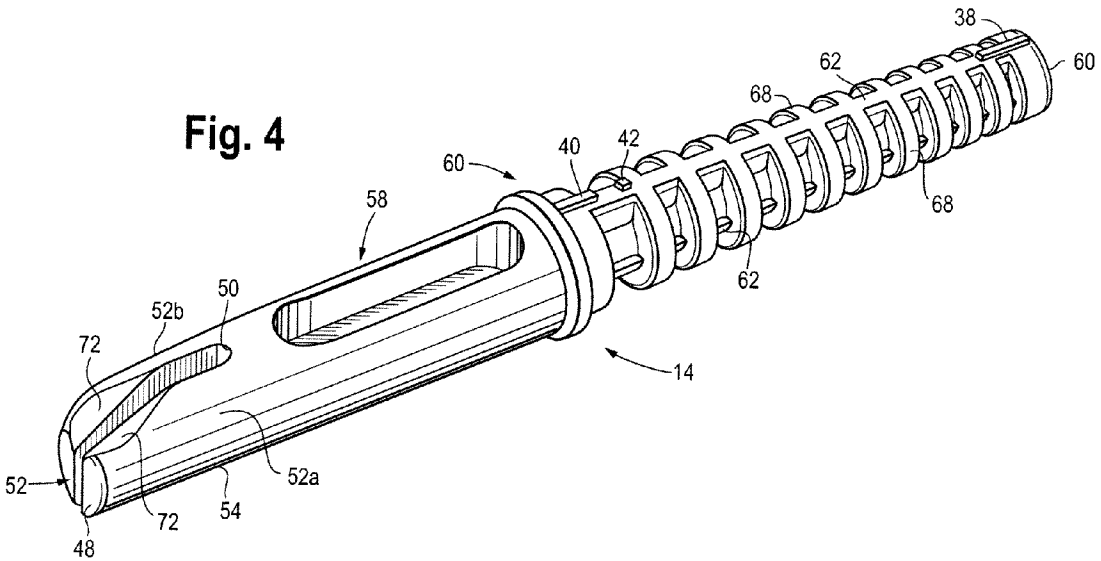
FIG. 4 is a top side perspective view of the balloon tying device of the embodiment of FIG. 1.
Figure 5:
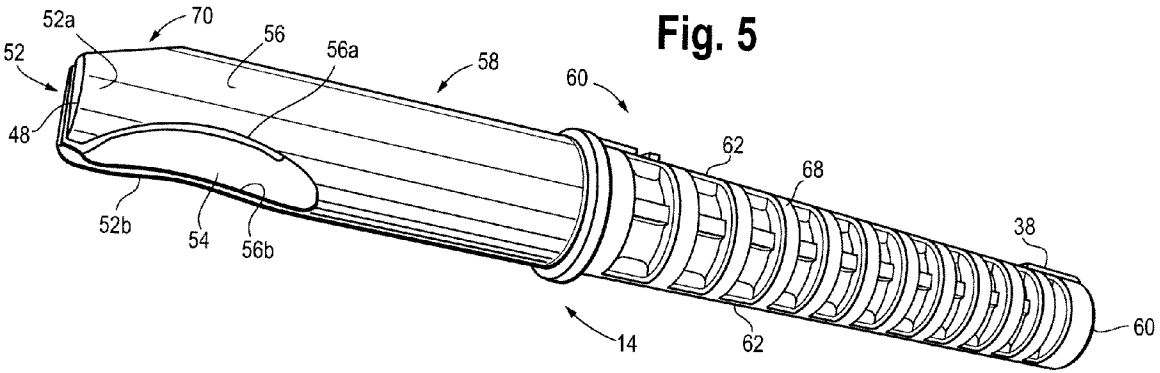
FIG. 5 is a bottom side perspective view of the balloon tying device of FIG. 4.

FIG. 4 and FIG. 5 are views of the improved tying device 14. As shown in FIG. 4, the tying device 14 includes a distal end 58, and a proximal end 60, the latter adapted to be inserted into the receptacle 26. The proximal end 60 includes a pair of longitudinally extending ridges 62 on opposing sides of the cylindrical body of the tying device 14. Ridges 62 extend along the length of the proximal end 60 of the tying device.

The proximal end 60 also includes a plurality of circumferential ribs 68 on opposing sides of the tying device 14 that extend between the ridges 62. The number of circumferential ribs 68 are sufficient to extend along the length of the proximal end 60 of tying device 14.

Referring to FIGS. 1A, 1B and 2, the receptacle 26 is a substantially circular bore 63 provided with a plurality of slots 64 that are transverse to the axis of insertion of the device 14 into the receptacle 26. The slots 64 extend through and between opposing walls 65 of the receptacle 26 (FIG. 1B). The inside surfaces of the receptacle 26 that form bore 63 extend axially from the entrance 67 of the receptacle, and the inside surfaces are relatively smooth and complementary to the outside diameter of the ribs 68 of the tying device 14, with the exception of the inner diameter of the last several walls 65, designated 65*a* in FIG. 1B. As shown in FIG. 1B, the last several walls 65*a* have an inner diameter smaller than the inner diameter of the remaining walls 65. This will create a snap fit with the last three ribs 68 on the tying device 14 when the tying device is inserted into the receptacle 26. In the illustrated embodiment, three inward-extending snap receptacle walls 65*a* may exist either in or between the slots 64. In one case, the receptacle 26 may receive ribs 68 of tying device 14 in the area between the slots 64.

As seen in FIG. 1B, the end 69 of bore 63 includes an inwardly extending flange 71 having an inner diameter less than the outer diameter of end rib 68*b* of tying device 14. This prevents a user from inadvertently inserting the tying device 14 into the wrong end of bore 63 of receptacle 26.

When inserting the tying device 14 into receptacle 26, the user inserts the tying device 14 into bore 63 until the last three walls 65*a* in receptacle 26 frictionally engage the three last ribs 68 on tying device 14 to provide a snap fit between the receptacle 26 and the tying device 14. To remove the tying device 14 from the receptacle 26, the user pulls firmly to dislodge the ribs 68 of the tying device from the walls 65*a* of the receptacle, thus disengaging the snap fit and allowing the tying device 14 to be moved axially out of receptacle 26.

As shown in FIG. 1A, an axially extending keyway 36 is provided in an upper portion of the bore 63 inside the receptacle 26. The tying device 14, as seen in FIG. 4, has a radially outward extending key 38 corresponding in dimensions slightly less than the keyway 36 in the receptacle 26. The key 38 is located on the forward or proximal end 60 (FIG. 4) of tying device 14. A pair of stabilizing keys 40, 42 are located on the proximal 60 end of tying device 14, but rearward of key 38 and adjacent distal end 58. Stabilizing keys 40, 42 are aligned with key 38 such that as tying device 14 is properly inserted into receptacle 26, both key 38 and stabilizer keys 40, 42 will enter and move longitudinally in keyway 36.

Thus, when inserting the tying device 14 into the receptacle 26, the key 38 on the tying device will prevent the insertion unless the key 38 is aligned with and engages keyway 36. This feature helps the user to use the filing and tying device correctly because there is only one circumferential way of engaging the tying device 14 with the receptacle 26 of the filling device 16. This feature also prevents the tying device 14 from rotating in receptacle 26 during the course of tying a balloon.

As shown in FIG. 4 and FIG. 5, the tying device 14 is provided with a slot 52 having a length, a width and a depth. The diametrical length across marginal end 48 of the slot 52 in the illustrated embodiment extends across the full diameter of the tying device 14 at marginal end 48. The slot 52 extends parallel to and lies between opposing sides 52*a*, 52*b* of the tying device 14. The width of the slot 52 is sufficient to easily receive a flattened neck of a balloon, as will be described. The depth of the slot 52 extends along a longitudinal axis of the tying device 14 where the depth is defined by the distance from the marginal end 48 of the tying device 14 to a root 50 of the slot 52. In one illustrated embodiment, the depth of the slot 52 may be greater than a diameter of the cylindrical body of the tying device 14.

The slot 52 in the illustrated embodiment is also provided with a bevel 54 (FIG. 5) on both facing sides 52*a*, 52*b* of the slot 52. The bevel 54 is located adjacent the root 50, and the bevel 54 extends from the root 50 for a limited distance toward the marginal end 48 of tying device 14. In the illustrated embodiment, the bevel extends partially but not all the way to the marginal end 48 of tying device 14. The bevel 54 extends between and connects the inside walls of the slot 52 and the peripheral outer surface 56 of the tying device 14. The surfaces of bevel 54 curve in the shaft of the tying device 14 both longitudinally and circumferentially. The intersections 56*a*, 56*b* between the bevel 54 and the outer surface 56 of the shaft of tying device 14 are curved lines (FIG. 5). The bevel 54 as shown in FIG. 5 provides a wide beveled entrance to the slot 50 where the entrance extends downwards with respect to an inside wall of the slot 50. The wide entrance to bevel 54 is provided to better receive the rolled end portion on the distal end of the neck of the balloon 22, as will be described.

The bevel 54 receives the rolled end of the water balloon 22 so that no portion of the rolled end is outside of the slot 52. Retaining the rolled end of the balloon within the bevel during tying allows the neck to be pulled over the rolled end without contacting the rolled end, as will be explained.

Referring to FIG. 5, the marginal end 48 of tying device 14 is also provided with a tapered or beveled end 70 located predominantly on the side of the shaft of the tying device 14 diametrically opposite the bevel 54. The taper 70 may begin with a minimum taper at a location adjacent the root 50 of slot 52, and increase to maximum taper at the marginal end 48. The taper may be curved or defined by a flattened area, or the taper may have the shape of a portion of a truncated cone.

The slot 52 is also provided with two leading tapered surfaces 72 (FIG. 4) on the side of tying device 14 opposite the bevel 54. The leading tapered surfaces 72 connect the inner walls of the slot 52 and the outside, peripheral surface 56 of the shaft of the tying device 14. The two leading tapered surfaces 72 are located at different sides of the shaft of the tying device 14 divided by the slot 52. The leading tapered surfaces 72 are used to help the user guide the neck of the balloon 22 into the slot 52.

Figure 7:
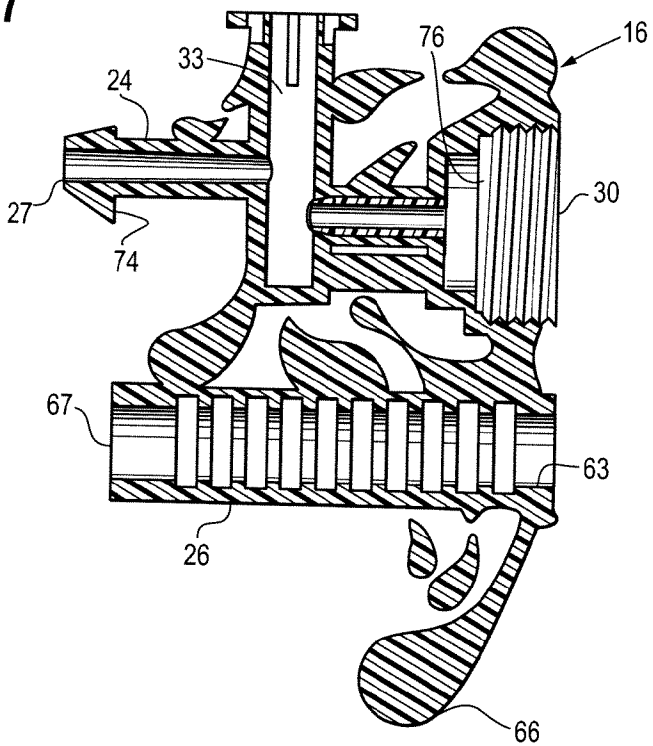
FIG. 7 is a section view of another embodiment of the balloon filing device of the present invention, showing the balloon filling nozzle entry portion having an elongated flange on one side of the nozzle entry to provide an improved seal between the balloon and the nozzle after filling a balloon with fluid.

In a second embodiment of the invention, and as illustrated in FIG. 7, the balloon barb 24 comprises a downward elongated bottom nozzle flange 74 on the marginal end 27 of the balloon barb 24. In the embodiment shown in FIG. 7, the elongated bottom nozzle flange 74 has an oval shape. The elongated part of the flange 74 is located on the side of the balloon barb 24 that has the smallest relative distance from the tying device 14. In the embodiment of FIG. 7, the radius of the flange 74 on the upper regular side is 0.010 inch, and on the elongated bottom side is 0.025 inch, by way of example. This elongated bottom nozzle structure prevents water from dripping from balloon barb 24 when filling the balloon.

Turning now to the operation of the disclosed invention, an explanation is provided as to how the filling and tying device 10 may be used to fill the balloon 22 and then readily form a knot in the neck of the balloon.

The filling and tying device 10 does not have to be attached to a fixed structure. The device 10 is adapted to be attached to a garden hose, which provides the mobility to be able to use the device 10 over a wider area than those devices that are required to be attached to a fixed structure.

To begin operation and referring to FIG. 1, garden hose 12 is connected to balloon filling and tying device 10 by inserting external threads 31 of hose 12 into female hose connector 20 of device 10, and rotating connector 20 until threads 31 and internal threads 30 of connector 20 are tightly engaged. A washer 76 (FIG. 1) in connector 20 provides a water tight connection between hose 12 and connector 20. Hose 12 is then opened to allow water to flow to filling and tying device 10.

Figures 6A, 6B, 6C:
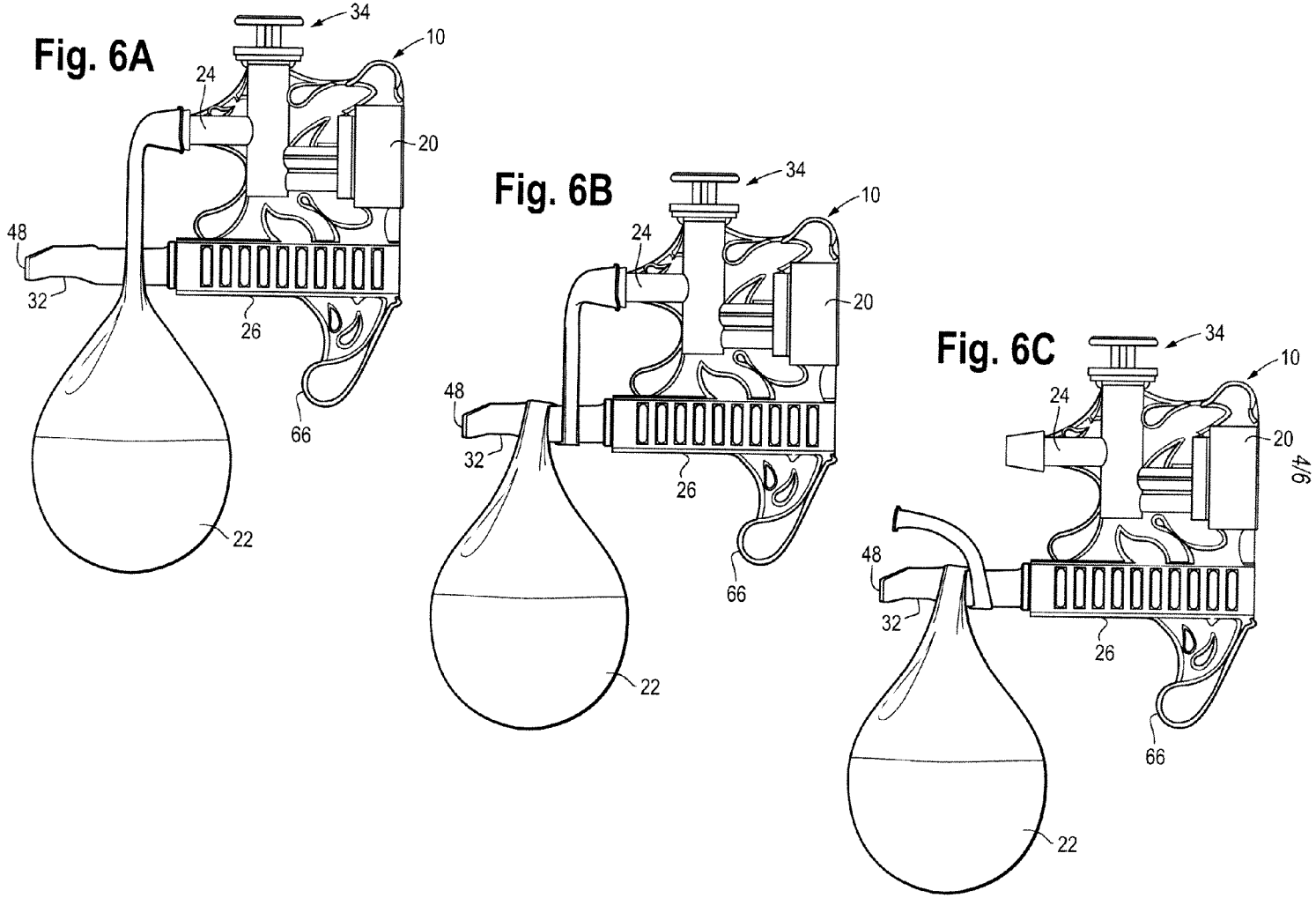
FIGS. 6A-E depict a set of steps that may be used by the balloon filling and balloon tying devices of FIG. 1 to tie a knot in a balloon subsequent to inflating or filling the balloon.

The rolled mouth and a portion of the neck of balloon 22 is then slipped over balloon barb 24 (FIGS. 1 and 6A). Once the mouth of the balloon 22 is extended over the balloon barb 24, the valve 34 is opened by applying manual downward pressure to water control button 44, thereby allowing pressurized fluid to enter and inflate the balloon 22. When the balloon 22 is filled to its desired capacity, control button 44 is released, and the flow of water to the balloon ceases.

Referring to FIGS. 6B-E, once the balloon 22 has been inflated, the balloon 22 is looped one time around the tying device 14 as shown in FIG. 6B. In the case where the pressurized fluid is water, the balloon may be looped around the tying device 14 by a user simply grasping the body 16 of the device 10 in the palm of the user's hand with the balloon barb 24 of the tying device 14 extending away from a body of the user. The user may use his/her other hand to wrap the neck of the balloon 22 around the outward end 32 of the tying device 14. Alternatively, the user may laterally swing the device 10 in a slow looping motion to cause the balloon 22 to wrap around the tying device 14. In this case, the balloon barb 24 retains the mouth of the balloon 22 during filling and the looping step without the necessity of the user having to secure the mouth to the balloon barb 24.

Figure 6E:
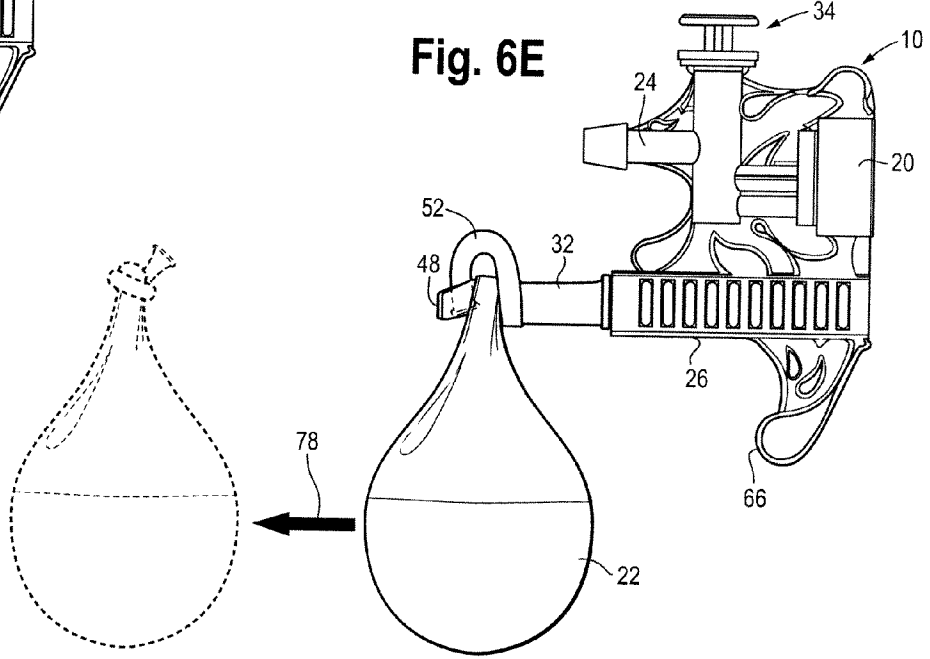
Figure 6D:
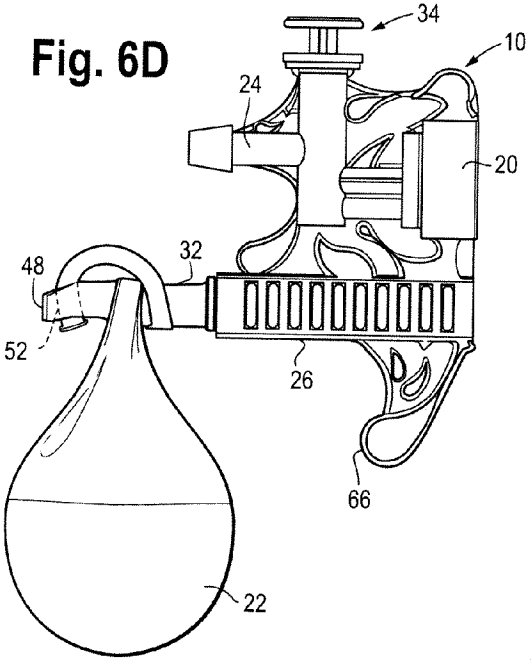

Next, the user detaches the rolled mouth of the balloon 22 from the balloon barb 24 (FIG. 6C) and pulls the neck and mouth of the balloon over and across the marginal end 48 of the tying device 14 so that the neck of the balloon enters the slot 52 as shown in FIG. 6D. When the user releases the mouth of the balloon, the resilient nature of the neck of the balloon pulls the rolled mouth into the bevel 54 of the slot 52 between and through the leading tapered surfaces 72.

As a final step, the user grasps the body of the balloon 22 and pulls the body away from the device 10 in a direction 78 parallel to the tying device 14 and away from the device 10 as shown in FIG. 6E. As the user pulls on the body of the balloon, the looped neck slides along the tying device 14 towards the marginal end 48 while the rolled mouth of the balloon continues to be held in the bevel 54. As the looped neck finally slides off the marginal end 48 of the body of the tying device 14 over tapered end 70, the mouth of the balloon continues to be held in the bevel 54, thereby completing a knot in the neck of the balloon. Once the looped neck disengages from the tying device 14 and the knot is complete, the mouth of the balloon disengages from the bevel 52.

As can be seen from the steps of FIGS. 6A-6E, the filling and tying device 10 allows balloons to be filled and tied with a minimum of effort even for persons with limited dexterity. For example, the device 10 may be held in one hand while the user uses his/her other hand to engage the mouth of the balloon 22 to insert the mouth of the balloon over balloon barb 24. More specifically, a person may hold the device 10 attached to the hose 12 in the palm of his/her hand with his/her fingers extending around the device 10 with his/her forefinger on one side of the finger grip 66 and the remaining fingers on the other side of the finger grip 66. This is convenient because the user's thumb is free to control the valve 34 while leaving the user's other hand free to manipulate the balloon 22. In this case, the balloon may be easily and quickly filled and tied with only a minimal amount of effort.

A specific embodiment of a balloon filling and tying device has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. An apparatus for filling a balloon with a fluid and tying a knot in the neck of the balloon, comprising:

a filling device body adapted to engage a source of fluid under pressure;

a balloon barb extending outwards from the body;

a fluid passageway in the body, the fluid passageway communicating with a control for the passage of fluid from the source to the balloon barb;

a tying device extending from the body substantially parallel to the balloon barb, the tying device being detachable from and reattachable to a receptacle in the body of the filling device;

a keyway located in one of the tying device and an inner surface of the receptacle; and a key in the other of the tying device and the receptacle, the key corresponding in dimensions to fit in the keyway, the key removably fitting into the keyway when the tying device is inserted in the receptacle of the body of the filling device.

2. The apparatus of claim 1 wherein the keyway is in the tying device and the key is on the inner surface of the receptacle.

3. The apparatus of claim 1 wherein the keyway is in the inner surface of the receptacle and the key is on the tying device.

4. The apparatus of claim 1 wherein the balloon barb extends outwards from the body along a predominant axis, and the receptacle further comprises an axis of insertion of the tying device into the receptacle, the axis of insertion extending parallel to the predominant axis.

5. The apparatus of claim 1 further including a snap fit engagement between the receptacle and the tying device.

6. The apparatus of claim 1 wherein the filling device further comprises a hose connector extending outwards from a body of the filling device.

7. The apparatus of claim 1 wherein the control for the passage of fluid comprises a valve within the body, the valve having an open state where the valve forms an open conduit between the hose connector and the balloon barb and a closed state where the conduit is blocked.

8. The apparatus of claim 1 wherein the tying device comprises a shaft having a longitudinal axis, a slot extending diametrically across a marginal end of the shaft, the slot having a depth extending along a longitudinal axis of the shaft.

9. The apparatus of claim 8 wherein the tying device has a bevel located in the shaft, the bevel extending on opposing sides of the slot, the bevel curving in the shaft both longitudinally and circumferentially relative to the shaft, the bevel intersecting the outer surface of the shaft along curved lines.

10. The apparatus of claim 9 wherein the bevel extends from adjacent a root of the slot toward the marginal end of the cylindrical shaft.

11. The apparatus of claim 8 wherein the shaft has a tapered end on a side of the shaft opposite the bevel, the tapered end starting adjacent the root of the slot and ending with a maximum taper on the marginal end of the shaft, the taper being divided by the slot.

12. The apparatus of claim 9 wherein the shaft has leading tapered surfaces at the side of the shaft opposite the bevel, the leading tapered surfaces starting at the marginal end of the shaft, the leading tapered surfaces extending on the shaft in a direction away from the marginal end of the shaft.

13. The apparatus of claim 12 wherein the leading tapered surfaces intersect with the internal walls of the slot.

* * * * *